US006742990B2

(12) United States Patent
Dehning et al.

(10) Patent No.: US 6,742,990 B2
(45) Date of Patent: Jun. 1, 2004

(54) PANEL OPTIMIZED FOR EDGE STIFFNESS AND GASKET COMPRESSION

(75) Inventors: Jeffrey D. Dehning, West Salem, WI (US); Charles K. Kopplen, La Crosse, WI (US); Michael D. Lewis, La Crosse, WI (US); Donald G. Pestel, Onalaska, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/125,177

(22) Filed: Apr. 16, 2002

(65) Prior Publication Data

US 2003/0194315 A1 Oct. 16, 2003

(51) Int. Cl.[7] ..... F04D 29/62
(52) U.S. Cl. ..... 415/213.1; 415/214.1
(58) Field of Search ..... 415/213.1, 214.1; 416/244 R

(56) References Cited

U.S. PATENT DOCUMENTS 1,699,434 A 1/1929 Jordan
2,576,860 A * 11/1951 Shapiro ..... 285/231
3,450,124 A 6/1969 Mauller, Jr.
4,706,434 A * 11/1987 Cotter ..... 52/520
5,038,543 A * 8/1991 Neyer ..... 52/528
5,088,299 A * 2/1992 Peterson ..... 62/298
5,641,331 A * 6/1997 Diachuk ..... 55/343
5,970,769 A * 10/1999 Lipari ..... 72/131
6,255,583 B1 * 7/2001 Johnson et al. ..... 174/35 R

* cited by examiner

*Primary Examiner*—Ninh H. Nguyen
(74) *Attorney, Agent, or Firm*—William J. Beres; William O'Driscoll

(57) ABSTRACT

An air handler enclosure includes a sheet metal panel fastened to a frame of the enclosure with a gasket sealingly compressed between the frame and the face of the panel. The outer edges of the panel are folded over to create a hem that overlays the face of the panel. The gasket is placed against the face of the panel, just inside the inner periphery of the hem. When the panel is installed, the hem abuts the frame to serve as a spacer that keeps the face of the panel a certain distance away from the frame. In this way, the hem prevents the gasket from being over compressed or crushed between the frame and the face of the panel.

27 Claims, 4 Drawing Sheets

PANEL OPTIMIZED FOR EDGE STIFFNESS AND GASKET COMPRESSION

BACKGROUND OF THE INVENTION

1. Field of the Invention

The present invention pertains to enclosures for air handlers, and more specifically to an enclosure panel whose edge is formed for improving edge stiffness and for limiting gasket compression.

2. Description of Related Art

Air conditioning systems typically include an air-handler that provides conditioned air to a comfort zone, such as a room or a designated area within a building. The conditioning of the air may include, but not be limited to heating, cooling, humidifying, dehumidifying, filtering, ventilating, and their various combinations. Air handlers often include an enclosure that houses various components, such as a blower, filter, heat exchanger, controls, etc. The blower, which forces air through the system, may draw air from within the building and/or from outside.

The air-handler's enclosure typically comprises a frame to which several sheet metal panels are attached. Installing compressible gaskets between the frame and the panels can help keep rain and outside air from leaking into the enclosure. The gaskets can also help keep conditioned discharge air from leaking out. Usually a series of screws or rivets around the panel's perimeter fasten the panel to the frame, which sealingly compress the gasket between the panel and the frame.

To be effective, however, the fasteners should be uniformly tightened to provide a predetermined amount of gasket compression. Excessive tightening of the fastener can distort the panel and even damage the gasket. The distortion not only creates a wavy appearance along the edges of the panel but may also create leaks, as a wavy surface does not seal well against a generally flat gasket. An insufficiently tightened fastener, on the other hand, may also create leaks by providing insufficient gasket compression.

Currently, there is a need for an enclosure design that avoids the problem of improperly compressing a gasket between a sheet metal panel and the frame of the enclosure.

SUMMARY OF THE INVENTION

To help ensure a gasket is properly compressed underneath a panel of an enclosure, it is an object of the invention to provide the panel with a peripheral hem that limits the gasket's compression.

Another object of some embodiments of the invention is fasten the panel to a frame of the enclosure using fasteners that extend through the gasket without extending through the hem.

Another object of some embodiments is to provide the hem of the panel with a surface that is generally flush with the gasket when the gasket is compressed up against the frame of the enclosure.

Yet, another object of some embodiments of the invention is to provide a panel with a material thickness that is substantially equal to the compressed thickness of the gasket.

A further object of some embodiments is to provide a generally rectangular panel whose corners are designed to avoid interfering with properly compressing a gasket.

A still further object is to provide a panel for an enclosure that is particularly suited for housing air handling equipment, such as a blower.

Another object is to provide a panel that limits gasket compression to a point that helps prevent the gasket from taking on a detrimental set.

These and other objects of the invention are provided by a panel with a peripheral hem that limits a gasket's compression.

The present invention provides an air handler enclosure for housing a blower. The air handler enclosure comprises: a frame; a panel that includes a face member with a hem extending along an outer perimeter of the face member; and a gasket adjacent the hem and compressed between the face member and the frame. The hem overlaps the face member and is held directly up against the frame.

The present invention also provides a panel assembly. The panel assembly comprises: a face member having an outer perimeter; a hem having a proximal edge and a distal edge; and a gasket disposed up against the face member and adjacent the distal edge of the hem. The proximal edge lies along the outer perimeter of the face member, the hem extends inward from the outer perimeter so that the distal edge overlaps the face member, and the hem and the face member comprise a unitary piece.

The present invention further provides an air handler. The air handler comprises: an enclosure that includes a sealing surface disposed around an opening in the enclosure; a blower disposed inside the enclosure; a face member having an outer perimeter; a hem having a proximal edge and a distal edge, wherein the proximal edge lies along the outer perimeter of the face member; a gasket adjacent the distal edge of the hem and compressed between the face member and the sealing surface of the enclosure; and a plurality of fasteners spaced apart from the hem, extending through the face member and the gasket, and attached to the enclosure to hold the gasket and the hem against the sealing surface of the enclosure. The hem extends inward from the outer perimeter so that the distal edge overlaps the face member, and the hem and the face member comprise a unitary panel that covers the opening of the enclosure.

The present invention additionally provides a method of sealing a flat panel to a linear support. The method comprises the steps of: hemming the flat panel; positioning a gasket adjacent a hem formed by the hemming step; and using the hem as a spacer to establish the maximum amount of compression for the gasket.

The present invention yet further provides an arrangement for sealing a flat panel to a linear support. The arrangement comprises: a flat panel having a hem; a linear support contacting the hem; and a gasket contacting the panel and linear support where the gasket is positioned adjacent the hem.

DESCRIPTION OF THE PREFERRED EMBODIMENT

Figure 1:
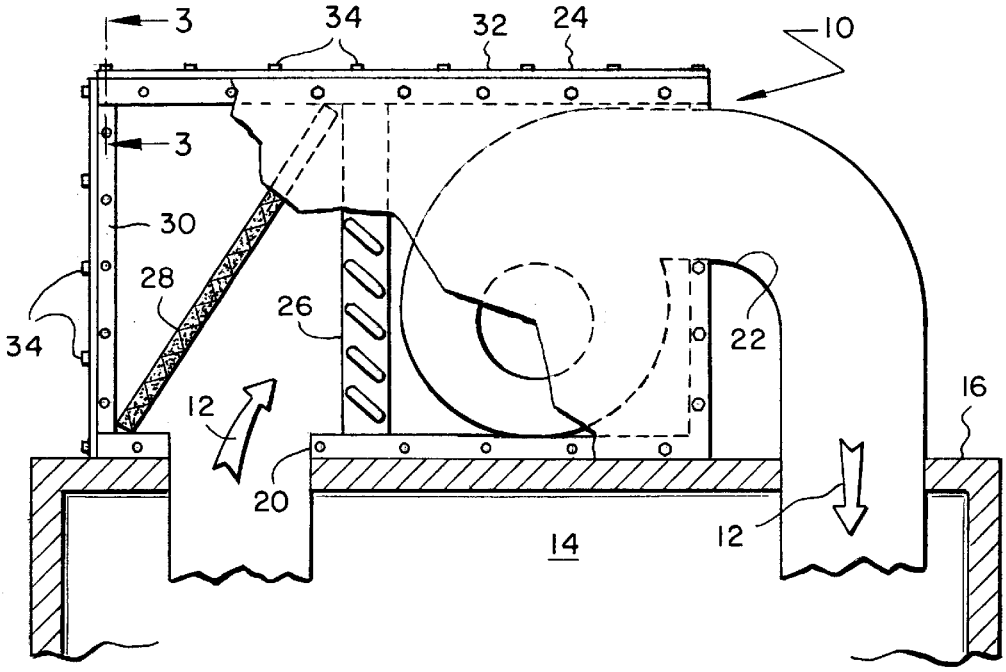
FIG. 1 is a cutaway view of an air handler enclosure according to one embodiment of the invention.

An air handler 10, in FIG. 1, is schematically illustrated to represent any device that conveys air 12 for heating, ventilating, filtering, humidifying, de-humidifying, or otherwise conditioning the air of a comfort zone 14, room, or area within a building 16. Examples of air handler 10 include, but are not limited to, a blower within an enclosure, a furnace, air conditioner, heat pump, and various combinations thereof. For the illustrated embodiment of the invention, air handler 10 comprises a blower 18 that moves air 12 between an inlet 20 and an outlet 22 of an enclosure 24. As air 12 passes through enclosure 24, the air is heated or cooled by a heat exchanger 26 and filtered by an air filter 28.

Figure 3:
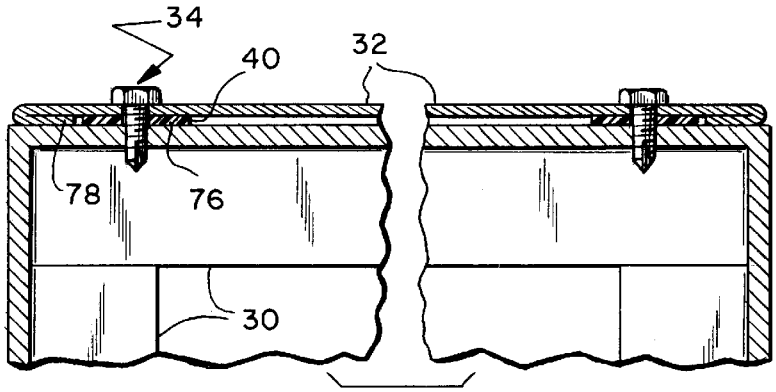
FIG. 3 is a cross-sectional view taken along line 3—3 of FIG. 1, wherein the gasket is shown in a compressed state.
Figure 4:
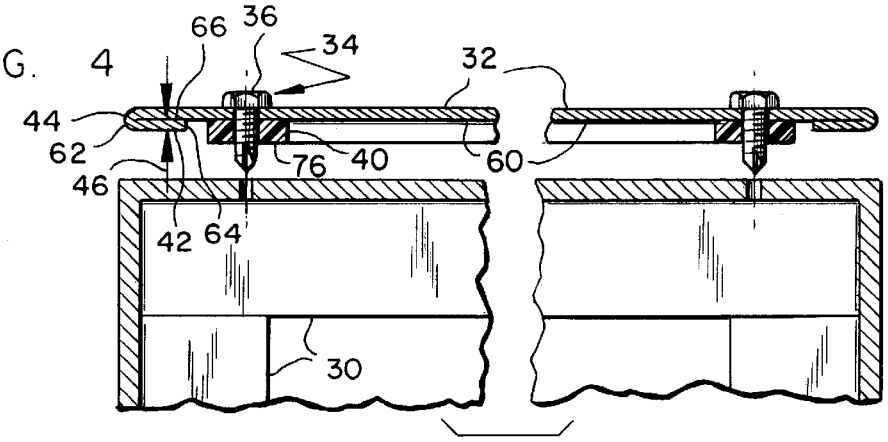
FIG. 4 is similar to FIG. 3, but showing a panel in the process of being installed, wherein the gasket is shown in a decompressed state.
Figure 2:
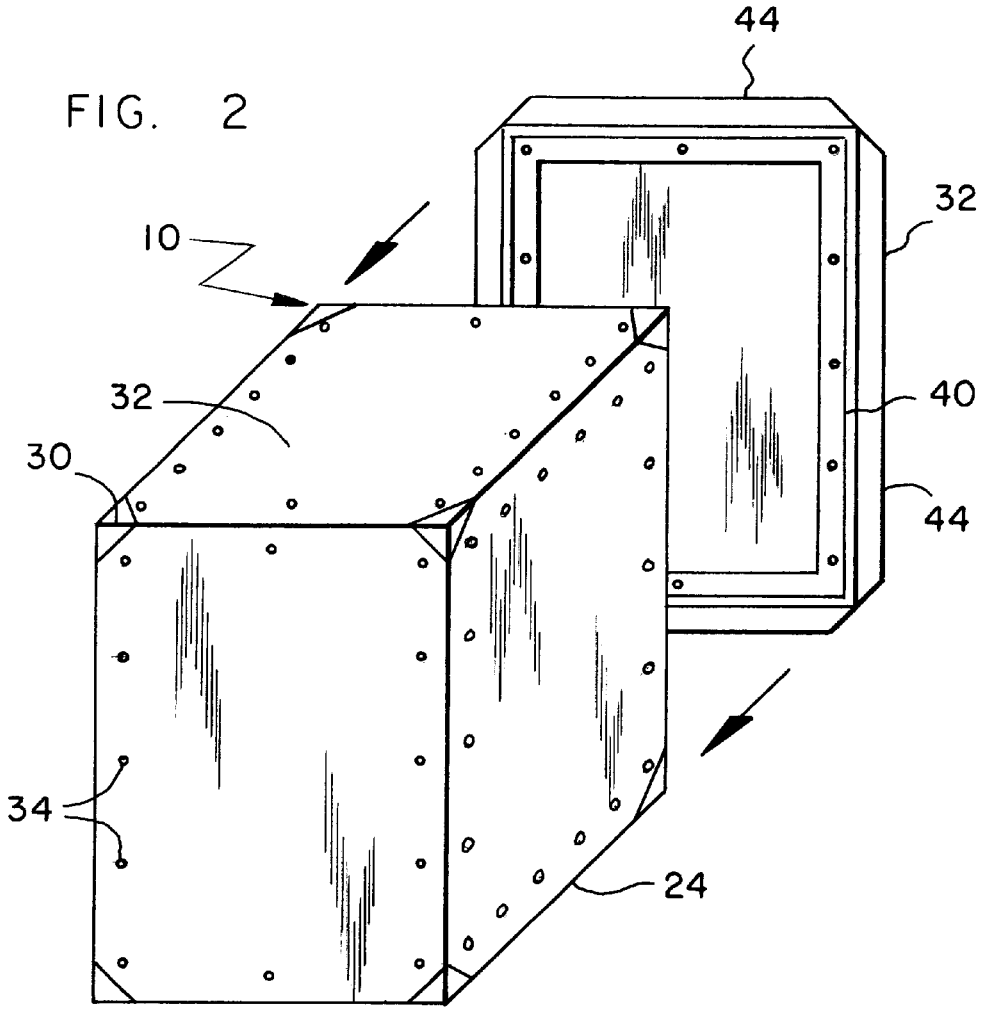
FIG. 2 is a perspective view showing a panel being installed on the enclosure of FIG. 1.

Referring further to FIGS. 2–4, enclosure 24 comprises a frame 30 to which one or more panels 32 are attached. A series of fasteners 34 (e.g., self-tapping screws 36, sheet metal screws, machine screws and nuts, rivets, etc.) hold panel 32 against frame 30 and sealingly compress a gasket 40 between panel 32 and various structural members of frame 30. Examples of such structural members include, but are not limited to, structural channels and angle iron, sheet metal formed in various shapes, and plastic or aluminum extrusions.

To help ensure that gasket 40 is properly compressed, a hem 42 is formed around an outer perimeter 44 of panel 32. Hem 42 has a material thickness 46 that helps prevent gasket 40 from being compressed to a thickness much less than that of material thickness 46, as shown in FIG. 3. The actual design of hem 42 may vary; however, in a currently preferred embodiment, the panel and hem design generally follows that of FIGS. 5 and 6.

Figure 5:
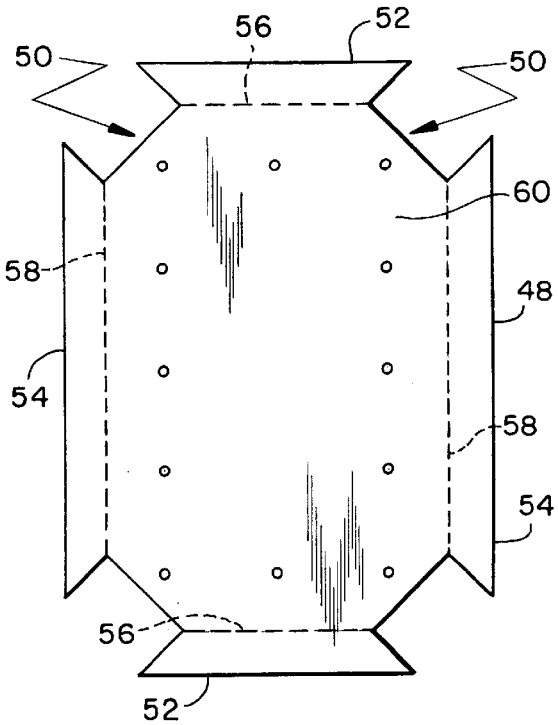
FIG. 5 shows a flat piece of sheet metal that can be folded to create a panel for the enclosure of FIG. 1.
Figure 6:
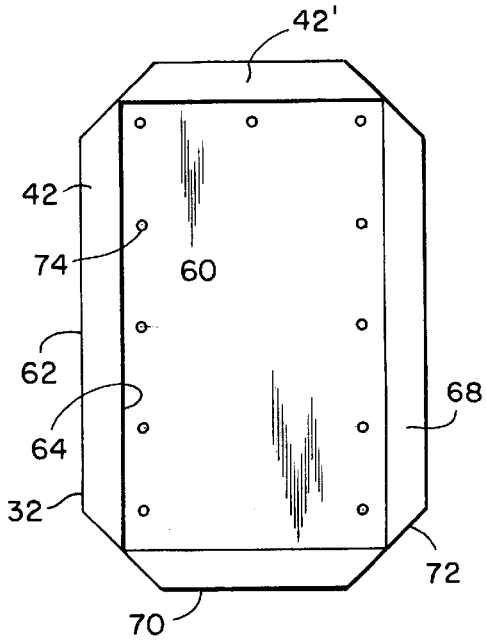
FIG. 6 shows the piece of sheet metal of FIG. 5 after having been folded to create a panel for the enclosure of FIG. 1.

Panel 32 begins as a generally flat, unitary piece of sheet metal 48 of substantially uniform thickness and with its corners 50 notched, as shown in FIG. 5. Edges 52 and 54 are folded inward along lines 56 and 58, so that edges 52 and 54 overlay a central face member 60 of panel 32. This creates panel 32 with hems 42 and 42', as shown in FIG. 6. More specifically, hem 42 includes a proximal edge 62 and a distal edge 64, wherein proximal edge 62 lies along outer perimeter 44 of face member 60. Hem 42 extends inward from outer perimeter 44, so that distal edge 64 overlaps face member 60 with a back surface 66 of hem 42 being pressed up against face member 60. Hem 42 is created in a similar manner. Referring to FIG. 6, the resulting panel 32 includes a first edge 68, a second edge 70 and a corner edge 72 between the two. In this embodiment, first edge 68 is perpendicular to second edge 70, and corner edge 72 is at an angle (i.e., other than 90 and 180 degrees) to edges 68 and 70. Holes 74 in face member 60 and a corresponding set of holes in gasket 40 are for inserting screws 36.

When installing panel 32, gasket 40 is placed adjacent the distal edge of the hems and is compressed between face member 60 and frame 30 as screws 36 are tightened. When compressed, a sealing surface 76 of gasket 40 is substantially coplanar with an adjacent surface 78 of hem 42, as shown in FIG. 3. When decompressed, however, sealing surface 76 protrudes further from face member 60 than does hem 42, as shown in FIG. 4.

Figure 7:
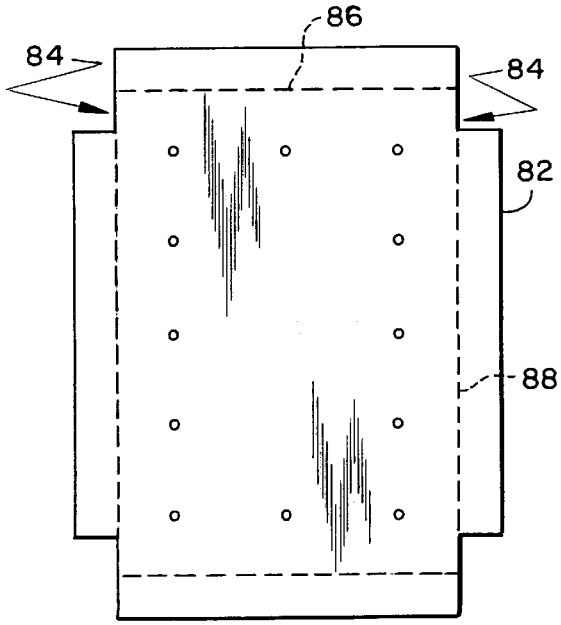
FIG. 7 is similar to FIG. 5 but the sheet metal is part of a second embodiment of the invention.
Figure 8:
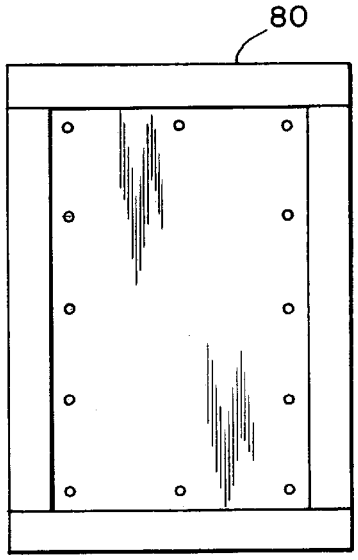
FIG. 8 shows the piece of sheet metal of FIG. 7 after having been folded to create a panel according to the second embodiment.

In another embodiment, shown in FIGS. 7 and 8, a panel 80 is made from a piece of sheet metal 82 whose corners 84 are notched out as shown in FIG. 7. Folding sheet metal 82 along lines 86 and 88 then creates panel 80, as shown in FIG. 8.

Figure 9:
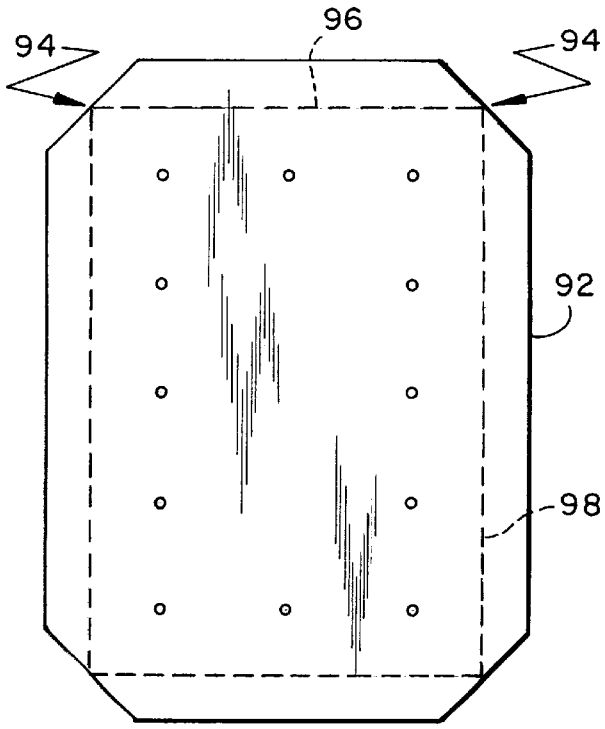
FIG. 9 is similar to FIG. 5 but the sheet metal is part of a third embodiment of the invention.
Figure 10:
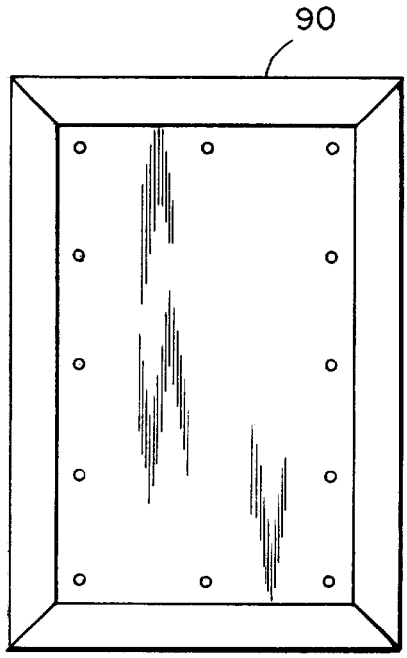
FIG. 10 shows the piece of sheet metal of FIG. 9 after having been folded to create a panel according to the third embodiment.

In another embodiment, shown in FIGS. 9 and 10, a panel 90 is made from a piece of sheet metal 92 whose corners 94 are notched out as shown in FIG. 9. Folding sheet metal 92 along lines 96 and 98 then creates panel 90, as shown in FIG. 10.

When comparing various panel designs, it should be noted that a hem's distal edge can be longer than, equal to, or shorter than the hem's proximal edge, as is the case with panels 32, 80 and 90 respectively.

Figure 11:
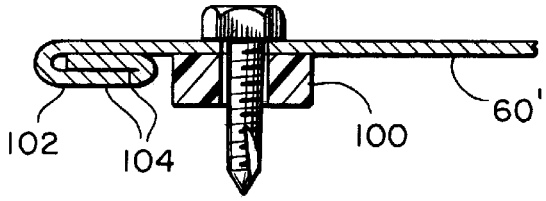
FIG. 11 is similar to FIG. 4, but illustrating yet another embodiment of the invention.

In some cases, a gasket 100 may be much thicker than the sheet metal thickness of a face panel 60', as shown in FIG. 11. To accommodate the extra thickness, the sheet metal can be folded over more than once to create a hem 102 that includes two or more sheet metal layers 104.

Although the invention is described with reference to a preferred embodiment, it should be appreciated by those skilled in the art that other variations are well within the scope of the invention. Therefore, the scope of the invention is to be determined by reference to the claims, which follow.

We claim:

1. An air handler enclosure for housing a blower, comprising:

a frame;

a panel that includes a face member with a hem extending along an outer perimeter of the face member, wherein the hem overlaps the face member and is held directly up against the frame; and a gasket adjacent the hem and compressed between the face member and the frame wherein the gasket in a compressed state is disposed against the face member and includes a sealing surface that is substantially coplanar with an adjacent surface of the hem.

2. The air handler enclosure claim 1, wherein the hem is of a single layer of sheet metal whose thickness is substantially equal to that of the face member.

3. The air handler enclosure claim 1, wherein the hem comprises a plurality of sheet metal layers.

4. An air handler enclosure for housing a blower, comprising;

a frame;

a panel that includes a face member with a hem extending along an outer perimeter of the face member, wherein the hem overlaps the face member and is held directly up against the frame;

a gasket adjacent the hem and compressed between the face member and the frame; and a plurality of fasterners spaced apart from the hem and extending through the face member and the gasket.

5. An air handler enclosure for housing a blower, comprising:

a frame;

a panel that includes a face member with a hem extending along an outer perimeter of the face member, wherein the hem overlaps the face member and is held directly up against the frame; and a gasket adjacent the hem and compressed between the face member and the frame;

wherein the outer perimeter of the face member includes a first edge, a second edge, and a corner edge therebetween, wherein the first edge is substantially perpendicular to the second edge, and the corner edge is at angle to both the first edge and the second edge.

6. The air handler enclosure claim 5, wherein the hem includes a first hem disposed along the first edge and a second hem disposed along the second edge.

7. A panel assembly, comprising:

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary piece;

a gasket disposed up against the face member and adjacent the distal edge of the hem; and a plurality of fasteners spaced apart from the hem and extending through the face member and the gasket.

8. The panel assembly of claim 7, wherein the gasket in a decompressed state protrudes further from the face member than does the hem.

9. The panel assembly of claim 7, wherein along the distal edge the hem includes a surface that is up against the face member.

10. The panel assembly of claim 7, wherein the hem is of a single layer of sheet metal whose thickness is substantially equal to that of the face member.

11. The panel assembly of claim 7, wherein the proximal edge is substantially the same length as the distal edge.

12. A panel assembly, comprising:

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary piece;

a gasket disposed up against the face member and adjacent the distal edge of the hem; and wherein the gasket in a compressed state includes a sealing surface that is substantially coplanar with an adjacent surface of the hem.

13. A panel assembly, comprising:

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary piece;

a gasket disposed up against the face member and adjacent the distal edge of the hem; and wherein the hem comprises a plurality of sheet metal layers.

14. A panel assembly, comprising:

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary piece;

a gasket disposed up against the face member and adjacent the distal edge of the hem; and wherein the proximal edge is shorter than the distal edge.

15. A panel assembly, comprising:

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary piece;

a gasket disposed up against the face member and adjacent the distal edge of the hem; and wherein the outer perimeter of the face member includes a first edge, a second edge, and a corner edge therebetween, wherein the first edge is substantially perpendicular to the second edge, and the corner edge is at angle to both the first edge and the second edge.

16. The panel assembly of claim 15, wherein the hem includes a first hem disposed along the first edge and a second hem disposed along the second edge.

17. A panel assembly, comprising:

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary piece;

a gasket disposed up against the face member and adjacent the distal edge of the hem; and wherein the proximal edge is longer than the distal edge.

18. A panel assembly, comprising:

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary piece;

a gasket disposed up against the face member and adjacent the distal edge of the hem; and further comprising an enclosure with a sealing surface that is substantially planar, wherein the hem and the gasket are held up against the sealing surface.

19. The panel assembly of claim 18, further comprising a blower disposed inside the enclosure.

20. An air handler, comprising:

an enclosure that includes a sealing surface disposed around an opening in the enclosure;

a blower disposed inside the enclosure;

a face member having an outer perimeter;

a hem having a proximal edge and a distal edge, wherein the proximal edge lies along the outer perimeter of the face member, the hem extends inward from the outer perimeter so that the distal edge overlaps the face member, and the hem and the face member comprise a unitary panel that covers the opening of the enclosure;

a gasket adjacent the distal edge of the hem and compressed between the face member and the sealing surface of the enclosure; and a plurality of fasteners spaced apart from the hem, extending through the face member and the gasket, and attached to the enclosure to hold the gasket and the hem against the sealing surface of the enclosure.

21. The air handler enclosure claim 20, wherein the hem is of a single layer of sheet metal whose thickness is substantially equal to that of the face member.

22. The air handler enclosure claim 20, wherein the hem comprises a plurality of sheet metal layers.

23. A method of sealing a flat panel to a linear support comprising the steps of:

hemming the flat panel;

positioning a gasket adjacent a hem formed by the hemming step; and using the hem as a spacer to establish the maximum amount of compression for the gasket.

24. The method of claim 23 including the further step of placing both the hem and the gasket in contact with the linear support.

25. The method of claim 23 including the further steps of affixing the panel to the linear support by a fastener.

26. The method of claim 25 wherein the fastener does not contact the hem but contacts the panel, the gasket and the linear support.

27. An arrangement for sealing a flat panel to a linear support comprising:

a flat panel having a hem;

a linear support contacting the hem;

a gasket contacting the panel and linear support where the gasket is positioned adjacent the hem; and a fastener affixing the panel to the linear support wherein the fastener contacts the panel, the gasket, and the linear support but not the hem.

* * * * *